US006935439B2

(12) United States Patent
Mercer

(10) Patent No.: US 6,935,439 B2
(45) Date of Patent: Aug. 30, 2005

(54) BORING TOOL CONTROL USING REMOTE LOCATOR

(75) Inventor: John E. Mercer, Kent, WA (US)

(73) Assignee: Merlin Technology, Inc., Renton, WA (US)

( * ) Notice: Subject to any disclaimer, the term of this patent is extended or adjusted under 35 U.S.C. 154(b) by 322 days.

(21) Appl. No.: 09/898,989

(22) Filed: Jul. 3, 2001

(65) Prior Publication Data

US 2001/0052426 A1 Dec. 20, 2001

Related U.S. Application Data

(63) Continuation of application No. 09/562,503, filed on May 1, 2000, now Pat. No. 6,279,668, which is a continuation of application No. 09/066,964, filed on Apr. 27, 1998, now Pat. No. 6,079,506.

(51) Int. Cl.[7] ..... G01V 1/00

(52) U.S. Cl. ..... 175/45; 340/853.4; 340/853.6; 324/326

(58) Field of Search ..... 175/45, 61; 340/853.2, 340/853.3, 853.4, 853.5, 853.6; 324/326, 207.17, 346

(56) References Cited

U.S. PATENT DOCUMENTS 3,362,750 A * 1/1968 Carnegie ..... 299/1.7
4,035,088 A * 7/1977 Jenkins et al. ..... 356/218
4,323,280 A * 4/1982 Lansberry et al. ..... 299/1.4
4,403,664 A * 9/1983 Sullinger ..... 175/24
4,708,395 A * 11/1987 Petry et al. ..... 299/17
4,881,083 A * 11/1989 Chau et al. ..... 342/459
4,914,433 A * 4/1990 Galle ..... 340/854.4
4,934,757 A * 6/1990 Steinkuhl et al. ..... 299/1.5
4,993,503 A * 2/1991 Fischer et al. ..... 175/62
5,337,002 A * 8/1994 Mercer ..... 324/326
5,363,926 A * 11/1994 Mizuno ..... 175/45
5,439,064 A * 8/1995 Patton ..... 175/45 X
5,513,710 A * 5/1996 Kuckes ..... 175/45
5,585,726 A * 12/1996 Chau ..... 324/326
5,698,981 A * 12/1997 Mercer ..... 324/329
5,711,381 A * 1/1998 Archambeault et al. ..... 175/45
5,904,210 A * 5/1999 Stump et al. ..... 175/45
5,937,954 A * 8/1999 Puttmann et al. ..... 175/61
5,941,307 A * 8/1999 Tubel ..... 166/313
6,035,951 A * 3/2000 Mercer et al. ..... 175/45
6,079,506 A * 6/2000 Mercer ..... 175/45
6,102,136 A * 8/2000 Archambeault et al. ..... 175/45

* cited by examiner

*Primary Examiner*—Sunil Singh
(74) *Attorney, Agent, or Firm*—Michael Pritzkau

(57) ABSTRACT

A drilling system performs underground boring using a drill rig and a boring tool which is configured for moving through the ground under control of the drill rig to form an underground bore. A monitoring arrangement, forming part of the system, includes a detection arrangement at the drill rig for monitoring at least one operational parameter to produce a data signal relating to at least one of a utility to be installed in the underground bore, the drill rig and the boring tool. A portable device forms another of the system for receiving the data signal relating to the operational parameter for use by the portable device. A communication arrangement, for example using telemetry, transfers the data signal from the drill rig to the portable device. The operational parameter may be monitored for the purpose of preventing equipment failure.

8 Claims, 5 Drawing Sheets

BORING TOOL CONTROL USING REMOTE LOCATOR

This application is a continuation of U.S. Ser. No. 09/562,503 filed May 1, 2000, now U.S. Pat. No. 6,279,668 which is a continuation of U.S. Ser. No. 09/066,964 filed Apr. 27, 1998, now U.S. Pat. No. 6,079,506.

BACKGROUND OF THE INVENTION

The present invention relates generally to underground boring tool guidance and, more particularly, to a remote walk over locator/controller configured for determining the underground location of a boring tool and for remotely issuing control commands to a drill rig which is operating the boring tool.

Installing underground utility cable using a steerable boring tool is well known in the art. Various examples are described in U.S. Pat. Nos. 5,155,442, 5,337,002, 5,444,382 and 5,633,589 as issued to Mercer et al (collectively referred to herein as the Mercer Patents), all of which are incorporated herein by reference. An example of the prior art Mercer technique is best illustrated in FIG. 1 herein which corresponds to FIG. 2 in the Mercer Patents. For purposes of clarity, the reference numerals used in the Mercer Patents have been retained herein for like components.

As seen in FIG. 1, an overall boring machine 24 is positioned within a starting pit 22 and includes a length of drill pipe 10, the front end of which is connected to the back end of a steerable boring head or tool 28. As described in the Mercer Patents, the boring tool includes a transmitter for emitting a dipole magnetic field 12 which radiates in front of, behind and around the boring tool, as illustrated in part in FIG. 1. A first operator 20 positioned at the starting pit 22 is responsible for operating the boring machine 24; that is, he or she causes the machine to let out the drill pipe, causing it to push the boring tool forward. At the same time, operator 20 is responsible for steering the boring tool through the ground. A second locator/monitor operator 26 is responsible for locating boring tool 28 using a locator or receiver 36. The boring tool is shown in FIG. 1 being guided beneath an obstacle 30. The locator/monitor operator 26 holds locator 36 and uses it to locate a surface position above tool head 28. Once operator 26 finds this position, the locator 36 is used to determine the depth of tool head 28. Using the particular locator of the present invention, operator 26 can also determine roll orientation and other information such as yaw and pitch. This information is passed on to operator 20 who then may use it to steer the boring tool to its target. Unfortunately, this arrangement requires at least two operators in order to manage the drilling operation, as will be discussed further.

Still referring to FIG. 1, current operation of horizontal directional drilling (HDD) with a walkover locating system requires a minimum of two skilled operators to perform the drilling operation. As described, one operator runs the drill rig and the other operator tracks the progress of the boring tool and determines the commands necessary to keep the drill on a planned course. In the past, communication between the two operators has been accomplished using walkie-talkies. Sometimes hand signals are used on the shorter drill runs. However, in either instance, there is often confusion. Because an operating drill rig is typically quite noisy, the rig noise can make it difficult, if not impossible, to hear the voice communications provided via walkie-talkie. Moreover, both the walkie-talkie and the hand signals are awkward since the operator of the drill rig at many times has both of his hands engaged in operation of the drill rig.

Confused steering direction can result in the drill being misdirected, sometimes with disastrous results.

The present invention provides a highly advantageous boring tool control arrangement in which an operator uses a walk-over locator unit that is configured for remotely issuing control commands to a drill rig. In this way, problems associated with reliable communications between two operators are eliminated. In addition, other advantages are provided, as will be described hereinafter.

SUMMARY OF THE INVENTION

As will be described in more detail hereinafter, there is disclosed herein a locator/control arrangement for locating and controlling underground movement of a boring tool which is operated from a drill rig. An associated method is also disclosed. The boring tool includes means for emitting a locating signal. In accordance with the present invention, the locator/control arrangement includes a portable device for generating certain information about the position of the boring tool in response to and using the locating signal. In addition to this means for generating certain information about the position of the boring tool, the portable device also includes means for generating command signals in view of this certain information and for transmitting the command signals to the drill rig. Means located at the drill rig then receives the command signals whereby the command signals can be used to control the boring tool.

In accordance with one aspect of the present invention, the means located at the drill rig for receiving the command signals may include means for indicating the command signals to a drill rig operator.

In accordance with another aspect of the present invention, the means located at the drill rig for receiving the command signals may include means for automatically executing the command signals at the drill rig in a way which eliminates the need for a drill rig operator.

In accordance with still another aspect of the present invention, drill rig monitoring means may be provided for monitoring particular operational parameters of the drill rig. In response to the particular operational parameters, certain data may be generated which may include a warning that one of the parameters has violated an acceptable operating value for that parameter. In one feature, the certain data regarding the operational parameters may be displayed at the drill rig. In another feature, the certain data regarding the operational parameters may be displayed on the portable device. The latter feature is highly advantageous in embodiments of the invention which contemplate elimination of the need for a drill rig operator.

BRIEF DESCRIPTION OF THE DRAWINGS

The present invention may be understood by reference to the following detailed description taken in conjunction with the drawings, in which.

DETAILED DESCRIPTION OF THE INVENTION

Figure 1:
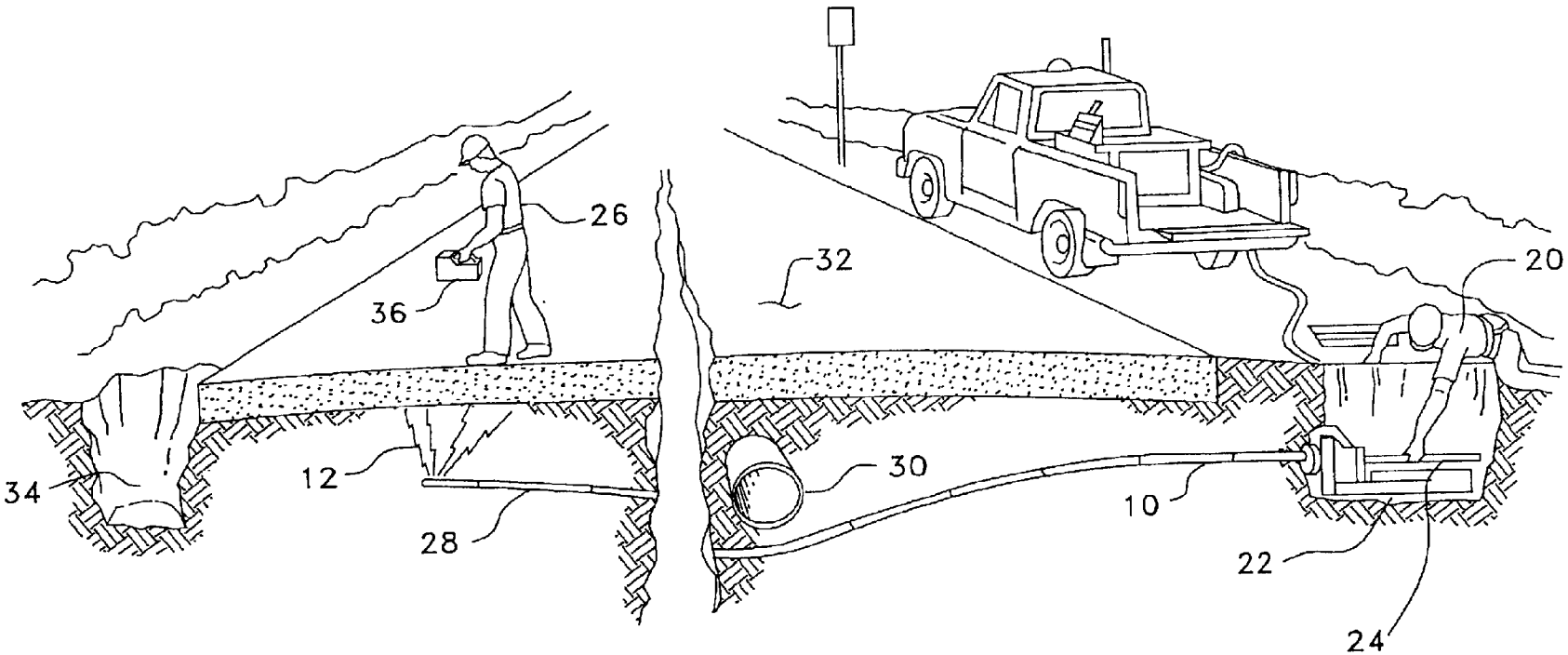
FIG. 1 (PRIOR ART)
FIG. 1 is a partially broken away elevational and perspective view of a boring operation described in the previously recited Mercer Patents.
Figure 2:
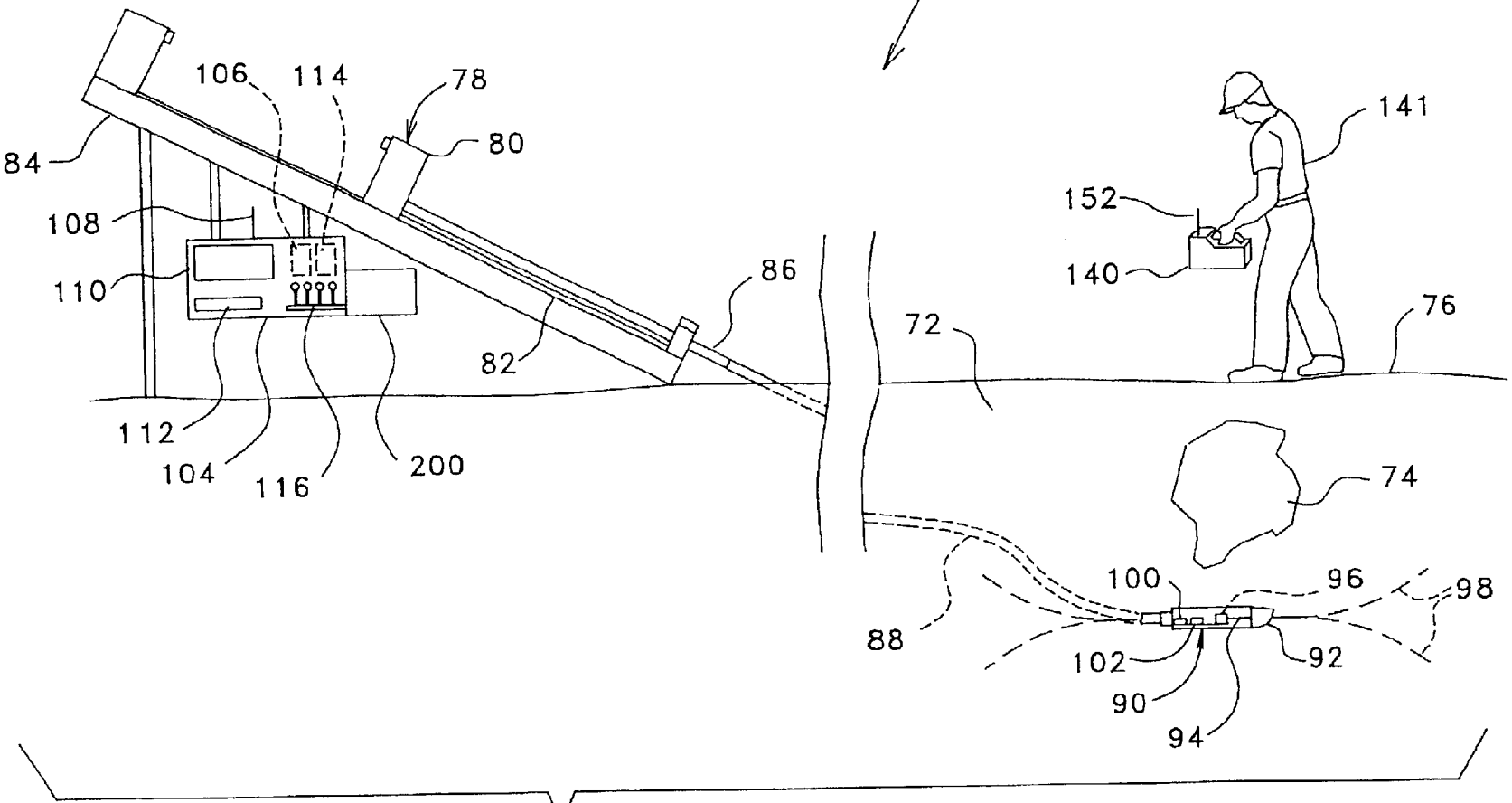
FIG. 2 is an elevational view of a boring operation being performed in accordance with the present invention in which a portable locator/controller is used.

Turning again to the drawings, attention is immediately directed to FIG. 2 which illustrates a horizontal boring operation being performed using a boring/drilling system generally indicated by the reference numeral 70. The drilling operation is performed in a region of ground 72 including a boulder 74. The surface of the ground is indicated by reference numeral 76.

System 70 includes a drill rig 78 having a carriage 80 received for movement along the length of an opposing pair of rails 82 which are, in turn, mounted on a frame 84. A conventional arrangement (not shown) is provided for moving carriage 80 along rails 82. During drilling, carriage 80 pushes a drill string 86 into the ground and, further, is configured for rotating the drill string while pushing, as will be described. The drill string is made up of a series of individual drill string sections or pipes 88, each of which includes a suitable length such as, for example, ten feet. Therefore, during drilling, sections 88 must be added to the drill string as it is extended or removed from the drill string as it is retracted. In this regard, drill rig 78 may be configured for automatically adding or removing the drill string sections as needed during the drilling operation. Underground bending of the drill string sections enables steering, but has been exaggerated for illustrative purposes.

Still referring to FIG. 2, a boring tool 90 includes an asymmetric face 92 and is attached to the end of drill string 86. Steering of the boring tool is accomplished by orienting face 92 of the boring tool (using the drill string) such that the boring tool is deflected in the desired direction. Boring tool 90 includes a mono-axial antenna such as a dipole antenna 94 which is driven by a transmitter 96 so that a magnetic locating signal 98 is emanated from antenna 94. Power may be supplied to transmitter 96 from a set of batteries 100 via a power supply 102. A control console 104 is provided for use in controlling and/or monitoring the drill rig. The control console includes a drill rig telemetry transceiver 106 connected with a telemetry receiving antenna 108, a display screen 110, an input device such as a keyboard 112, a processor 114, and a plurality of control levers 116 which, for example, hydraulically control movement of carriage 80 along with other relevant functions of drill rig operation.

Still referring to FIG. 2, in accordance with the present invention, drilling system 70 includes a portable locator/controller 140 held by an operator 141. With exceptions to be noted, locator 140 may be essentially identical to locator 36, as described in the Mercer Patents.

Figure 3:
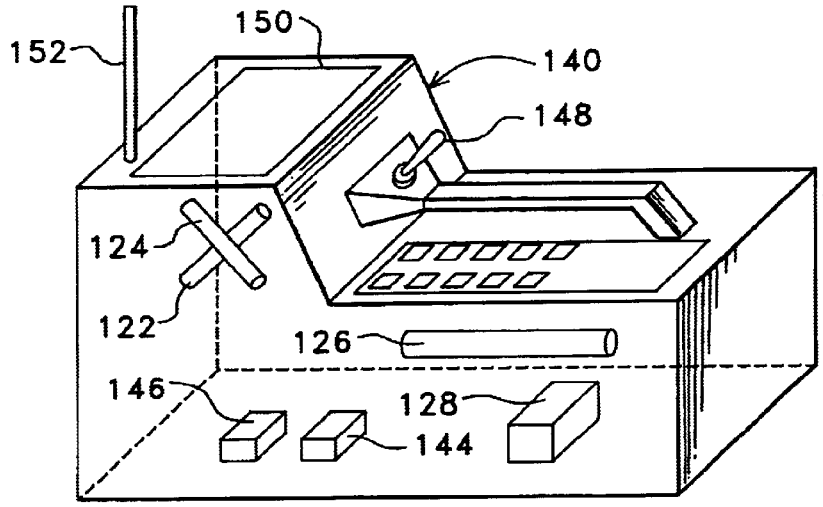
FIG. 3 is a diagrammatic perspective view of the portable locator/controller which is used in the boring operation of FIG. 2, shown here to illustrate details of its construction.

Turning to FIG. 3 in conjunction with FIG. 2, the same reference numerals used to describe locator 36 in the Mercer Patents have been used to designate corresponding components in locator/controller 140. In order to understand and appreciate the present invention, the only particular components of locator 36 that form part of locator 140 and that are important to note here are the antenna receiver arrangement comprised of orthogonal antennas 122 and 124 and associated processing circuitry for measuring and suitably processing the field intensity at each antenna and roll/pitch antenna 126 and associated processing circuitry 128 for measuring the pitch and roll of the boring tool. Inasmuch as the Mercer patents fully describe the process by which locator 140 is used to find the position of boring tool 90, the reader is referred to the patents for a detailed description of the locating method.

Figure 4:
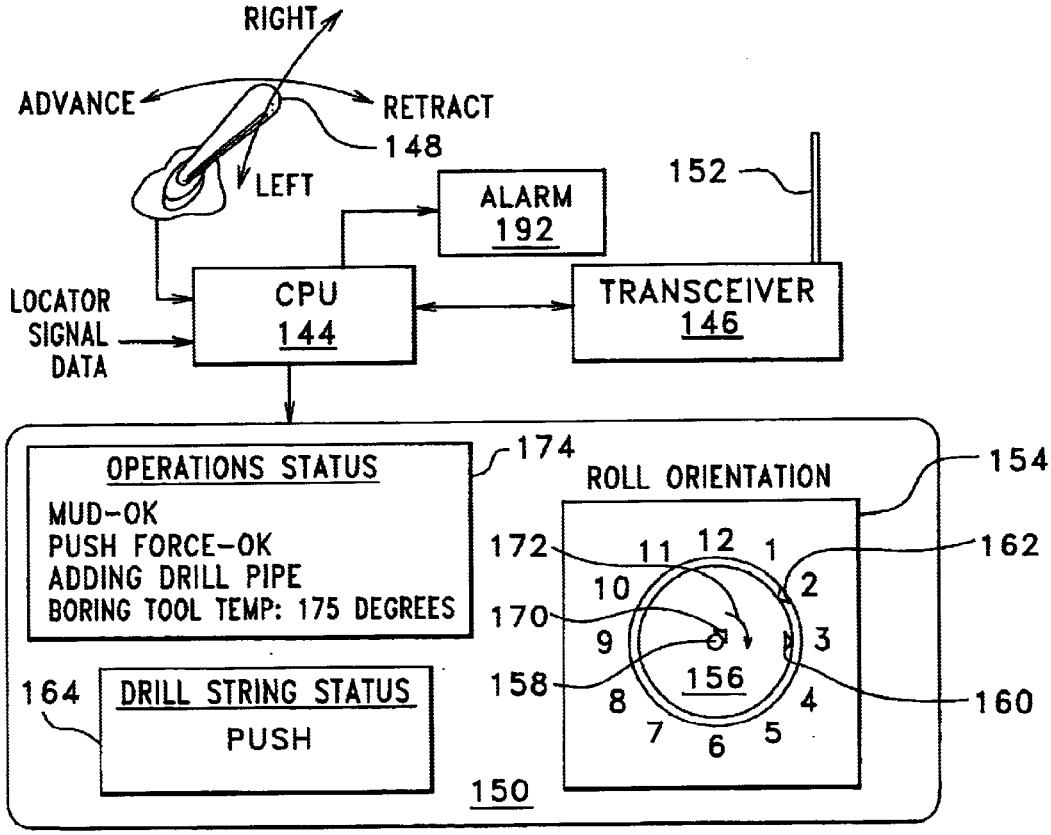
FIG. 4 is a partial block diagram illustrating details relating to the configuration and operation of the portable locator/controller of FIG. 3.

Referring to FIGS. 2–4, in accordance with the present invention, locator/controller 140 includes a CPU 144, interfaced with a remote telemetry transceiver 146, a joystick 148 and a display 150. Remote transceiver 146 is configured for two-way communication with drill rig transceiver 106 via an antenna 152. Joystick 148 is positioned in a convenient location for actuation by operator 141. In accordance with one highly advantageous feature of the present invention, operator 141 is able to remotely issue control commands to drill rig 78 by actuating joystick 148. Commands which may be issued to the drill rig by the operator include, but are not limited to (1) roll orientation for steering direction purposes, (2) "advance" and (3) "retract." It should be appreciated that the ability to issue these commands from locator/controller 140, in essence, provides for complete boring tool locating and control capability from locator/controller 140. A locator/controller command is implemented using CPU 144 to read operator actuations of the joystick, interpret these actuations to establish the operator's intended command, and then transfer the command to remote transceiver 146 for transmission to the command drill rig telemetry transceiver 106 at the drill rig, as will be described immediately hereinafter.

Still referring FIGS. 2–4, control commands are entered by using display 150 in conjunction with joystick 148. Display 150 includes an enhanced roll orientation/steering display 154 having a clock face 156 which shows clock positions 1 through 12. These clock positions represent the possible steering directions in which boring tool 90 may be set to travel. That is, the axis of the boring tool is assumed to extend through a center position 158 of the clock display and perpendicular to the plane of the figure. The desired roll orientation is established by moving joystick 148 either to the left or right. As the joystick is moved, a desired roll orientation pointer 160 incrementally and sequentially moves between the clock positions. For instance, if the desired roll pointer was initially located at the 12 o'clock position (not shown), the locator/controller operator may begin moving it to the 3 o'clock position by moving and holding the joystick to the right. CPU 144 detects the position of the joystick and incrementally moves the desired roll pointer to the 1 o'clock, then 2 o'clock, and finally the 3 o'clock position. At this point, the operator releases the joystick. Of course, at the 3 o'clock position, the command established is to steer the boring tool to the right. Similarly, the 6 o'clock position corresponds to steering downward, the 9 o'clock position corresponds to steering to the left and the 12 o'clock position corresponds to steering upward. As mentioned previously, steering is accomplished by setting face 92 of the boring tool in an appropriate position in accordance with the desired roll of the boring tool. With regard to boring tool steering, it is to be understood that boring tool steering has been implemented using concepts other than that of roll orientation and that the present invention is readily adaptable to any steering method either used in the prior art or to be developed.

Having established a desired steering direction, operator 141 monitors an actual roll orientation indicator 162. As described in the Mercer patents, roll orientation may be measured within the boring tool by a roll sensor (not shown). The measured roll orientation may then be encoded or impressed upon locating signal 98 and received by locator/controller 140 using antenna 126. This information is input to CPU 144 as part of the "Locator Signal Data" indicated in FIG. 4. CPU 144 then causes the measured/actual roll orientation to be displayed by actual roll orientation indicator 162. In the present example, operator 141 can see that the actual roll orientation is at the 2 o'clock position. Once the desired roll orientation matches the actual roll orientation, the operator will issue an advance command by moving joystick 148 forward. Advancement or retraction commands for the boring tool can only be maintained by continuously holding the joystick in the fore or aft positions. That is, a stop command is issued when joystick 148 is returned to its center position. If the locating receiver were accidentally dropped, the joystick would be released and drilling would be halted. This auto-stop feature will be further described in conjunction with a description of components which are located at the drill rig.

Still referring to FIGS. 2–4, a drill string status display 164 indicates whether the drill rig is pushing on the drill string, retracting it or applying no force at all. Information for presentation of drill string status display 164 along with other information to be described is transmitted from transceiver 106 at the drill rig and to transceiver 146 in the locator/controller. Once the boring tool is headed in a direction which is along a desired path, operator 141 can command the boring tool to proceed straight. As previously described, for straight drilling, the drill string rotates. In the present example, after having turned the boring tool sufficiently to the right, the operator may issue a drill straight command by moving joystick 148 to the left and, thereafter, immediately back to the right. These actuations are monitored by CPU 144. In this regard, it should be appreciated that CPU 144 may respond to any suitable and recognizable gesture for purposes of issuance of the drill straight command or, for that matter, CPU 144 may respond to other gestures to be associated with other desired commands. In response to recognition of the drill straight gesture, CPU 144 issues a command to be transmitted to the drill rig which causes the drill string to rotate during advancement. At the same time, CPU 144 extinguishes desired roll orientation indicator 160 and actual roll orientation indicator 162. In place of the roll orientation indicators, a straight ahead indication 170 is presented at the center of the clock display which rotates in a direction indicated by an arrow 172. It is noted that the straight ahead indication is not displayed in the presence of steering operations which utilize the desired or actual roll orientation indicators. Alternatively, in order to initiate straight drilling, the locator/controller operator may move the joystick to the left. In response, CPU 144 will sequentially move desired roll indicator 160 from the 3 o'clock position, to the 2 o'clock position and back to the 1 o'clock position. Thereafter, the desired roll indicator is extinguished and straight ahead indication 170 is provided. Should the operator continue to hold the joystick to the left, the 12 o'clock desired roll orientation (i.e., steer upward) would next be presented.

In addition to the features already described, display 150 on the locator/controller of the present invention may include a drill rig status display 174 which presents certain information transmitted via telemetry from the drill rig to the locator/controller. The drill rig status display and its purpose will be described at an appropriate point below. For the moment, it should be appreciated that commands transmitted to drill rig 78 from locator/controller 140 may be utilized in several different ways at the drill rig, as will be described immediately hereinafter.

Figure 5:
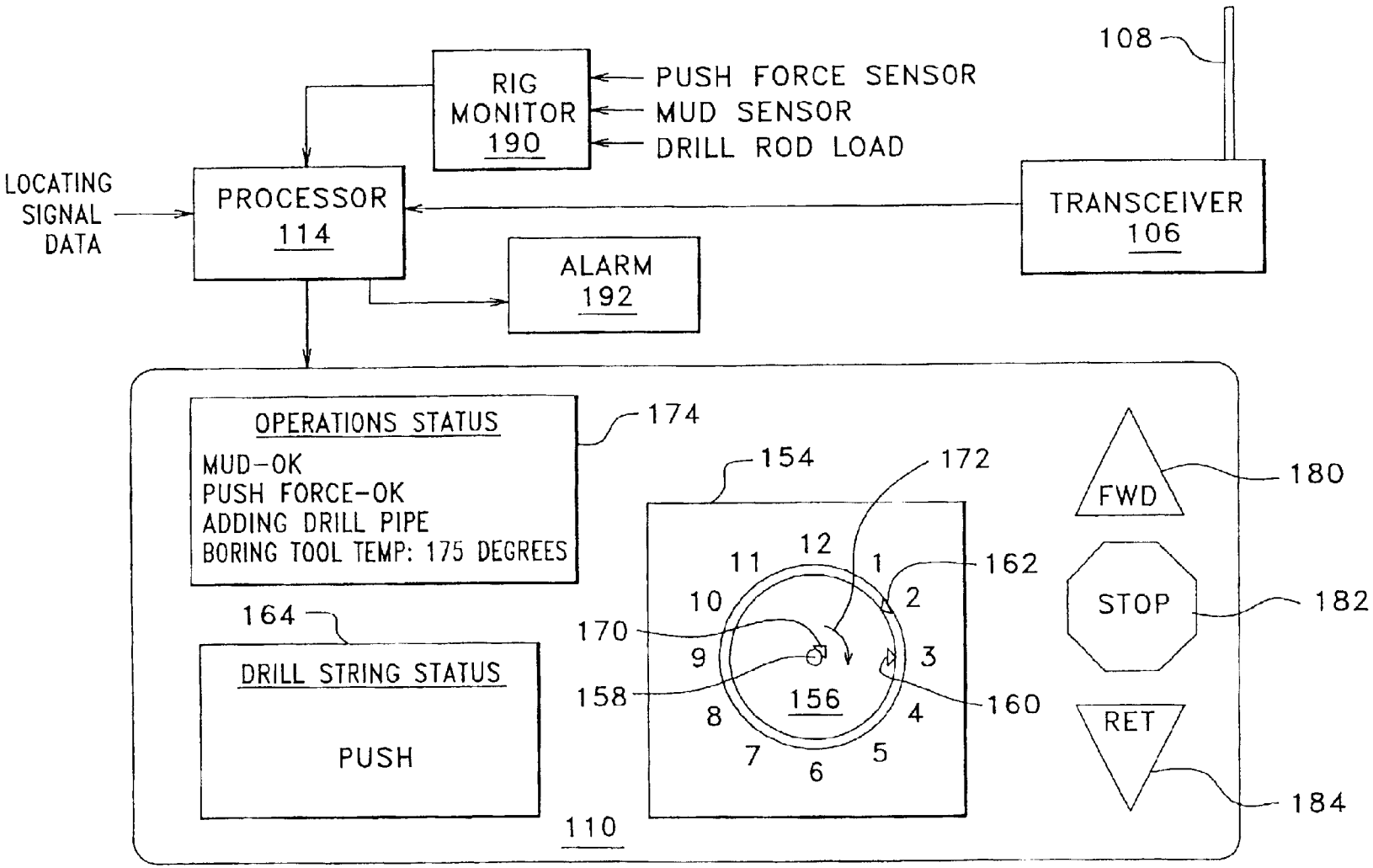
FIG. 5 is a partial block diagram illustrating details relating to the configuration and operation of one arrangement of components located at the drill rig for receiving command signals transmitted from the portable locator/controller of the present invention.

Attention is now directed to FIGS. 2 and 5. FIG. 5 illustrates a first arrangement of components which are located at the drill rig in accordance with the present invention. As described, two-way communications are established by the telemetry link formed between transceiver 106 at the drill rig and transceiver 146 at locator/controller 140. In this first component arrangement, display 110 at the drill rig displays the aforedescribed commands issued from locator/controller 140 such that a drill rig stationed operator (not shown) may perform the commands. Display 110, therefore, is essentially identical to display 150 on the locator/controller except that additional indications are shown. Specifically, a push or forward indication 180, a stop indication 182 and a reverse or retract indication 184 are provided. It is now appropriate to note that implementation of the aforedescribed auto-stop feature should be accomplished in a fail-safe manner. In addition to issuing a stop indication when joystick 148 is returned to its center position, the drill rig may require periodic updates and if the updates were not timely, stop indication 182 may be displayed automatically. Such updates would account for loss of the telemetry link between the locator/controller and the drill rig.

Still referring to FIGS. 2 and 5, the forward, stop and retract command indications eliminate the need for other forms of communication between the drill rig operator and the locator/controller operator such as the walkie-talkies which were typically used in the prior art. At the same time, it should be appreciated that each time a new command is issued from the locator/controller, an audible signal may be provided to the drill rig operator such that the new command does not go unnoticed. Of course, the drill rig operator must also respond to roll commands according to roll orientation display 154 by setting the roll of the boring tool to the desired setting. In this regard, it should be mentioned that a second arrangement (not shown) of components at the drill rig may be implemented with a transmitter at the locator/controller in place of transceiver 146 and a receiver at the drill rig in place of transceiver 106 so as to establish a one-way telemetry link from the boring tool to the drill rig. However, in this instance, features such as operations status display 174 and drill string status display 164 cannot be provided at the locator/controller.

It should be appreciated that the first and second component arrangements described with regard to FIG. 5 contemplate that the drill rig operator may perform tasks including adding or removing drill pipe sections 88 from the drill string and monitoring certain operational aspects of the operation of the drill rig. For example, the drill rig operator should insure that drilling mud (not shown) is continuously supplied to the boring tool so that the boring tool does not overheat whereby the electronics packaged housed therein would be damaged. Drilling mud may be monitored by the drill rig operator using a pressure gauge or a flow gauge. As another example, the drill rig operator may monitor the push force being applied to the drill string by the drill rig. In the past, push force was monitored by "feel" (i e., reaction of the drill rig upon pushing). However, push force may be directly measured, for instance, using a pressure or force gauge. If push force becomes excessive as a result of encountering an underground obstacle, the boring tool or drill string may be damaged. As a final example, the drill rig operator may monitor any parameters impressed upon locating signal 98 such as, for instance, boring tool temperature, battery status, roll, pitch and proximity to an underground utility. In this latter regard, the reader is referred to U.S. Pat. No. 5,757,190 entitled A SYSTEM INCLUDING AN ARRANGEMENT FOR TRACKING THE POSITIONAL RELATIONSHIP BETWEEN A BORING TOOL AND ONE OR MORE BURIED LINES AND METHOD which is incorporated herein by reference.

Referring to FIG. 5, another feature may be incorporated in the first and second component arrangements which is not requirement, but which nonetheless is highly advantageous with regard to drill rig status monitoring performed by the drill rig operator. Specifically, a rig monitor section 190 may be included for monitoring the aforementioned operational parameters such as drilling mud, push force and any other parameters of interest. As previously described, proper monitoring of these parameters is critical since catastrophic equipment failures or damage to underground utilities can occur when these parameters are out of range. In accordance with this feature, processor 114 receives the status of the various parameters being monitored by the rig monitor section and may provide for visual and/or aural indications of each parameter. Visual display occurs on operations status display 174. The display may provide real time indications of the status of each parameter such as "OK", as shown for drilling mud and push force, or an actual reading may be shown as indicated for the "Boring Tool Temperature". Of course, visual warnings in place of "OK" may be provided such as, for example, when excessive push force is detected. Audio warning may be provided by an alarm 192 in the event that threshold limits of any of the monitored parameters are violated. In fact, the audio alarm may vary in character depending upon the particular warning being provided. It should be mentioned that with the two-way telemetry link between the drill rig and locator/controller according to the aforedescribed first component arrangement, displays 164 and 174 may advantageously form part of overall display 150 on locator/controller 140, as shown in FIG. 4. However, such operational status displays on the locator/controller are considered as optional in this instance since the relevant parameters may be monitored by the drill rig operator. The full advantages of rig monitor section 190 and associated operations status display 174 will come to light in conjunction with a description of a fully automated arrangement to be described immediately hereinafter.

Figure 6:
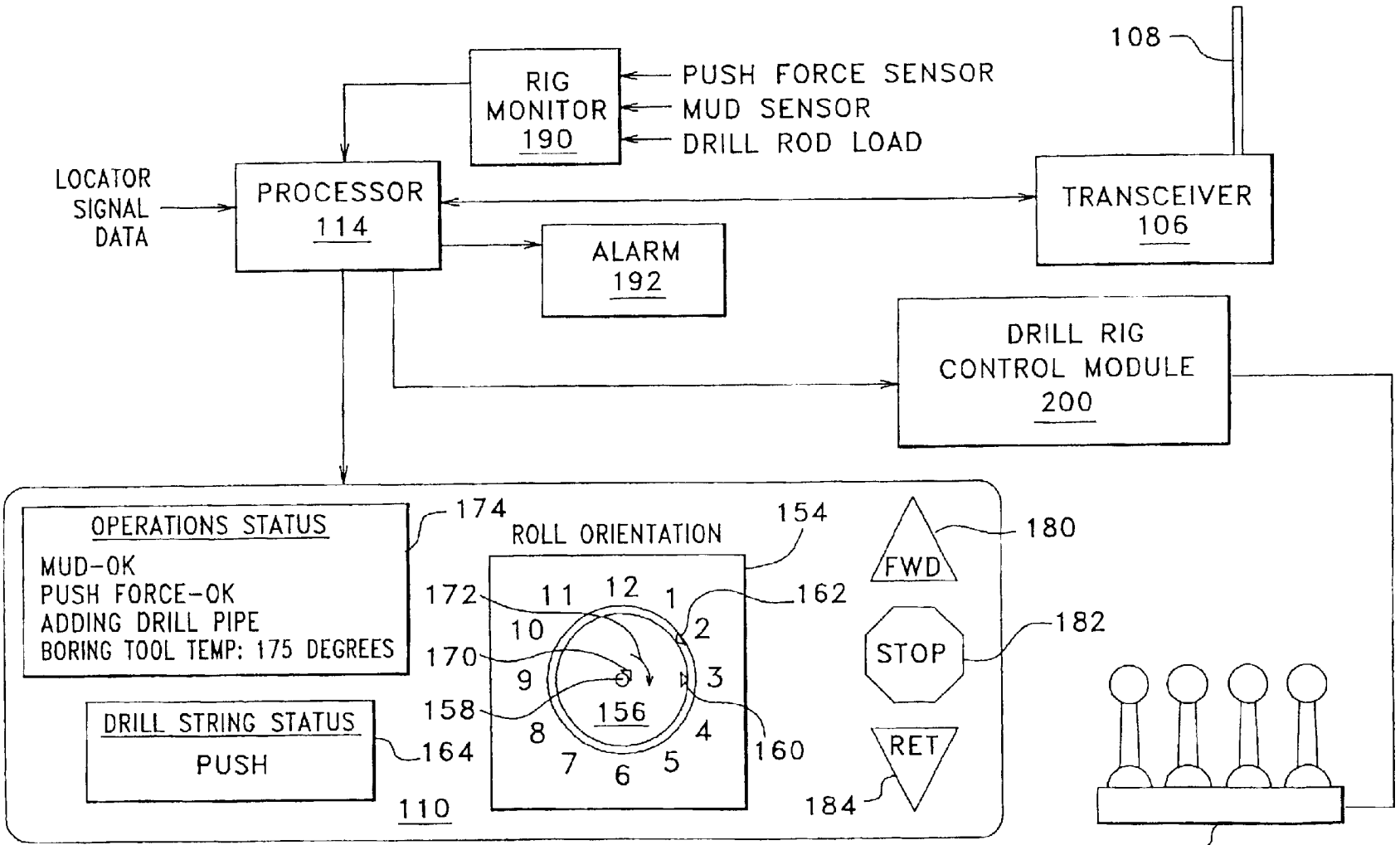
FIG. 6 is a partial block diagram illustrating details relating to the configuration and operation of another arrangement of components located at the drill rig for receiving command signals transmitted from the portable locator/controller and for, thereafter, executing the commands signals so as to eliminate the need for a drill rig operator.

Referring to FIGS. 2 and 6, in accordance with a third, fully automated arrangement of the present invention, a drill rig control module 200 is provided at drill rig 78. Drill rig control module 200 is interfaced with processor 114. In response to commands received from locator/controller 140, processor 114 provides command signals to the drill rig control module. The latter is, in turn, interfaced with drill rig controls 116 such that all required functions may be actuated by the drill rig control module. Any suitable type of actuator (not shown) may be utilized for actuation of the drill rig controls. In fact, manual levers may be eliminated altogether in favor of actuators. Moreover, the actuators may be distributed on the drill rig to the positions at which they interface with the drill rig mechanism. For reasons which will become apparent, this third arrangement requires two-way telemetry between the drill rig and locator/controller such that drill string status display 164 and operations status display 174 are provided as part of display 150 on the locator/controller. At the same time, these status displays are optional on display 110 at the drill rig.

Still referring to FIGS. 2 and 6, in accordance with the present invention, using locator/controller 140, operator 141 is able to issue control commands which are executed by the arrangement of FIG. 6 at the drill rig. Concurrent with locating and controlling the boring tool, operator 141 is able to monitor the status of the drill rig using display 150 on the locator/controller. In this regard, display 174 on the locator/controller also apprises the operator of automated drill rod loading or unloading with indications such as, for example, "Adding Drill Pipe." In this manner, the operator is informed of reasons for normal delays associated with drill string operations. Since push force applied by the drill rig to the drill string is a quite critical parameter, the present invention contemplates a feature (not shown) in which push force is measured at the drill rig and, thereafter, used to provide push force feedback to the operator via joystick 148 for ease in monitoring this critical parameter. The present invention contemplates that this force feedback feature may be implemented by one of ordinary skill in the art in view of the teaching provided herein. Still other parameters may be monitored at the drill rig and transmitted to locator/controller 140. In fact, virtually anything computed or measured at the drill rig may be transmitted to the locator/controller. For example, locator/controller 140 may display (not shown) deviation from a desired path. Path deviation data may be obtained, for example, as set forth in U.S. Pat. No. 5,698,981 entitled BORING TECHNIQUE which is incorporated herein by reference. Alternatively, path deviation data may be obtained by using a magnetometer (not shown) positioned in the boring tool in combination with measuring extension of the drill string. With data concerning the actual path taken by the boring tool, the actual path can be examined for conformance with minimum bend radius requirements including those of the drill string or those of the utility line which, ultimately, is to be pulled through the completed bore. That is, the drill string or utility line can be bent too sharply and may, consequently, suffer damage. If minimum bend radius requirements for either the drill string or utility are about to be violated, an appropriate warning may be transmitted to locator/controller 140. It should be appreciated that with the addition of the drill rig control module, complete remote operation capability has been provided. In and by itself, it is submitted that integrated locating capability and remote control of a boring tool has not been seen heretofore and is highly advantageous. When coupled with remote drill rig status monitoring capability, the present invention provides remarkable advantages over prior art horizontal directional drilling systems.

The advantages of the fully automated embodiment of the present invention essentially eliminate the need for a skilled drill rig operator. In this regard, it should be appreciated that the operator of a walkover locator is, in most cases, knowledgeable with respect to all aspects of drill rig operations. That is, most walkover locator operators have been trained as drill rig operators and then advance to the position of operating walkover locating devices. Therefore, such walkover locator operators are well versed in drill rig operation and welcome the capabilities provided by the present invention.

It should be understood that an arrangement for remotely controlling and tracking an underground boring tool may be embodied in many other specific forms and produced by other methods without departing from the spirit or scope of the present invention. Therefore, the present examples are to be considered as illustrative and not restrictive, and the invention is not to be limited to the details given herein, but may be modified within the scope of the appended claims.

What is claimed is:

1. In a drilling system for performing underground boring including a drill rig and a boring tool which is configured for moving through the ground under control of the drill rig to form an underground bore said boring tool including locating signal transmitter which transmits a locating signal for locating an underground position of the boring tool, a monitoring arrangement comprising:

a detection arrangement at said drill rig for monitoring at least one operations parameter to produce a data signal relating to at least one of a utility to be installed in the underground bore, the drill rig and the boring tool;

a portable device configured for movement by an operator and for receiving the data signal relating to the operational parameter for use by the portable device and said portable device including a locating section for receiving the locating signal, transmitted directly from the boring tool, for use in identifying the underground position of the boring tool; and a communication arrangement for transferring the data signal from the drill rig to the portable device.

2. The monitoring arrangement of claim 1 including a display arrangement, forming part of the portable device, for producing a display based on said data signal.

3. In a drilling system for performing underground boring including a drill rig and a boring tool which is configured for moving through the ground under control of the drill rig to form an underground bore and said boring tool includes a locating signal transmitter which transmits a locating signal for locating an underground position of the boring tool, a method comprising:

monitoring at least one operational parameter using a detection arrangement at said drill rig to produce a data signal relating to at least one of a utility to be installed in the underground bore, the drill rig and the boring tool;

transferring the data signal, relating to the operational parameter, to a portable device for use by the portable device; and configuring the portable device for movement by an operator and for receiving the locating signal directly from said locating signal transmitter in the boring tool for use in identifying the underground position of the boring tool.

4. The method of claim 3 including a display arrangement, forming part of the portable device, for producing a display based on said data signal.

5. In a drilling system for performing underground boring including a drill rig and a boring tool which is configured for moving through the ground under control of the drill rig to form an underground bore and said boring tool includes a locating signal transmitter which transmits a locating signal for locating an underground position of the boring tool, a monitoring arrangement comprising:

a detection arrangement for monitoring at least one operational parameter which is at least measurable at the drill rig to produce a data signal relating to at least one of a utility to be installed in the underground bore, the drill rig and the boring tool;

a portable device configured for movement by an operator thereof and for receiving the data signal relating to the operational parameter for use by the portable device and which includes a locating section for receiving the locating signal, directly from the boring tool, for use in identifying the underground position of the boring tool; and a communication arrangement for transferring the data signal from the detection arrangement to the portable device.

6. The monitoring arrangement of claim 5 including a display arrangement, forming part of the portable device, for producing a display based on said data signal.

7. In a drilling system for performing underground boring including a drill rig and a boring tool which is configured for moving through the ground under control of the drill rig to form an underground bore and said boring tool includes a locating signal transmitter which transmits a locating signal for locating an underground position of the boring tool, a method comprising:

monitoring at least one operational parameter which is at least measurable at said drill rig to produce a data signal relating to at least one of a utility to be installed in the underground bore, the drill rig and the boring tool;

transferring the data signal, relating to the operational parameter, to a portable device, for use by the portable device; and configuring the portable device for movement by an operator thereof and for receiving the locating signal, directly from the locating signal transmitter, for use in identifying the underground position of the boring tool.

8. The method of claim 7 including using a display arrangement, forming part of the portable device, for producing a display base on said data signal.

* * * * *